United States Patent [19]

Stahlecker

[11] Patent Number: 4,759,176

[45] Date of Patent: Jul. 26, 1988

[54] ARRANGEMENT FOR OPEN-END FRICTION SPINNING

[75] Inventor: Fritz Stahlecker, Josef-Neidhart-Strasse 18, 7347 Bad Ueberkingen, Fed. Rep. of Germany

[73] Assignees: Fritz Stahlecker; Hans Stahlecker, both of Fed. Rep. of Germany

[21] Appl. No.: 905,171

[22] Filed: Sep. 9, 1986

[30] Foreign Application Priority Data

Sep. 9, 1985 [DE] Fed. Rep. of Germany ..... 3532060

[51] Int. Cl.[4] ..... D01H 7/892; D01H 7/898; D01H 1/135

[52] U.S. Cl. ..... 57/401; 57/408; 57/411

[58] Field of Search ..... 57/401, 408, 411, 415

[56] References Cited

U.S. PATENT DOCUMENTS 4,483,136 11/1984 Stahlecker et al. ..... 57/401

4,522,023 6/1985 Stahlecker ..... 57/401

4,537,021 8/1985 Parker ..... 57/401

4,537,022 8/1985 Stahlecker ..... 57/401

4,571,932 2/1986 Stahlecker et al. ..... 57/401

*Primary Examiner*—John Petrakes

*Attorney, Agent, or Firm*—Barnes & Thornburg

[57] ABSTRACT

An open-end friction spinning arrangement is disclosed with two adjacently arranged rollers driven in the same rotational direction in forming a wedge-shaped year forming gap with their cover surfaces. It is provided that a suction device generates an air current directed into the wedge-shaped gap. This suction device creates differential suction forces at different zones of the wedge-shaped gap. The suction device includes different length suction slots in the respective friction rollers. An air inlet device having varying cross-sections along the length of the yarn forming gap is provided to optimize the effect of the slots and the air inlet opening in the forming yarn.

16 Claims, 2 Drawing Sheets

ARRANGEMENT FOR OPEN-END FRICTION SPINNING

BACKGROUND AND SUMMARY OF THE INVENTION

The invention relates to an arrangement for open-end friction spinning with two adjacently arranged rollers driven in the same rotational direction and forming a wedge-shaped gap which serves as yarn formation region, the rollers each including a perforated shell. Each shell contains a suction insert having a suction slot facing in the direction of the wedge-shaped gap and extending essentially in longitudinal direction to the gap. A fiber feeding device is provided containing a fiber feed channel which feeds single fibers into a dispersion zone along the wedge-shaped gap. Further, a yarn withdrawal device is included which withdraws the producing yarn in longitudinal direction of the wedge-shaped gap out of the dispersion zone and subsequently through a connecting treatment zone of the wedge-shaped gap. Further, a housing means is included covering the rollers in the area of the wedge-shaped gap. Arranged in the housing, the mouth of the fiber feed channel and an air inlet opening extend essentially in the longitudinal direction of the wedge-shaped gap.

With a known arrangement of the above-mentioned type such as disclosed in U.S. Pat. No. 4,483,136, the air inlet opening is coordinated to the roller rotating out of the wedge-shaped gap. An air stream is created through this air inlet opening which has the purpose to loosen the fibers which eventually are carried with the roller rotating outwardly from the yarn formation region. The air inlet opening extends beyond the area of the dispersion zone such that an air stream is produced which is directed into the wedge-shaped gap in the area of the treatment zone as it serves to hold the yarn in the gap. In this construction, the suction slots of the suction inserts as well as the air inlet opening exhibit a constant cross-section in the longitudinal direction of the yarn. With such an arrangement, it is difficult to proportion the spinning conditions and especially the friction effect in the area of the dispersion zone and the treatment zone.

It is also disclosed in commonly assigned U.S. application Ser. No. 694,779, filed Jan. 25, 1985, now U.S. Pat. No. 4,606,1887, to vary the suction effect along the length of the wedge-shaped gap.

It is an object of the present invention to provide an arrangement which provides for proportioning the spinning condition and especially the friction effect in the area of the dispersion zone and the treatment zone.

It is a further object according to certain preferred embodiments to provide an arrangement which proportions the suction conditions in the area of the dispersion zone and the treatment zone.

The objects are achieved in accordance with the invention by providing that the two suction slots of the two suction inserts are of a total cross-section that is changeable in longitudinal direction of the wedge-shaped gap, and that the air inlet opening essentially corresponds in size to the changing total cross-section of the suction slots in the longitudinal direction of the wedge-shaped gap.

The proportioning of the airstreams is accomplished by the arrangement of total cross-section of the suction slots of both suction inserts in connection with the size of the air inlet opening. The airstreams constitute an important aspect with regard to the friction effect in the wedge-shaped gap. It is thereby also possible to proportion the friction effect in the yarn withdrawal direction for obtaining optimum spinning results.

In a further development of certain preferred embodiments of the invention, it is provided that the suction slots of the suction inserts exhibit different lengths in longitudinal direction of the wedge-shaped gap. In this arrangement, it is possible to proportion the suction effect in a simple manner by retaining the same width of the suction slots.

In a further development of certain preferred embodiments of the invention, it is provided to adjust the size of the inlet air opening by means of an adjusting device. It is thereby made possible to accommodate spinning conditions with changing fiber materials and/or different yarn numbers.

In a still further development of the invention, it is provided that the cover is formed by a housing element surrounding the rollers at least in the area of the dispersion zone and the treatment zone to create a housing therefor. In this arrangement exactly defined airstreams are present in the area of the dispersion and the treatment zones which are not affected by any outside air flow. The airstreams are determined by the size of the air inlet opening and the size and length of the opening of the fiber feed channel.

Further objects, features, and advantages of the present invention will become more apparent from the following description when taken with the accompanying drawings which show, for purposes of illustration only, several embodiment in accordance with the present invention.

DETAILED DESCRIPTION OF THE DRAWINGS

Figure 1:
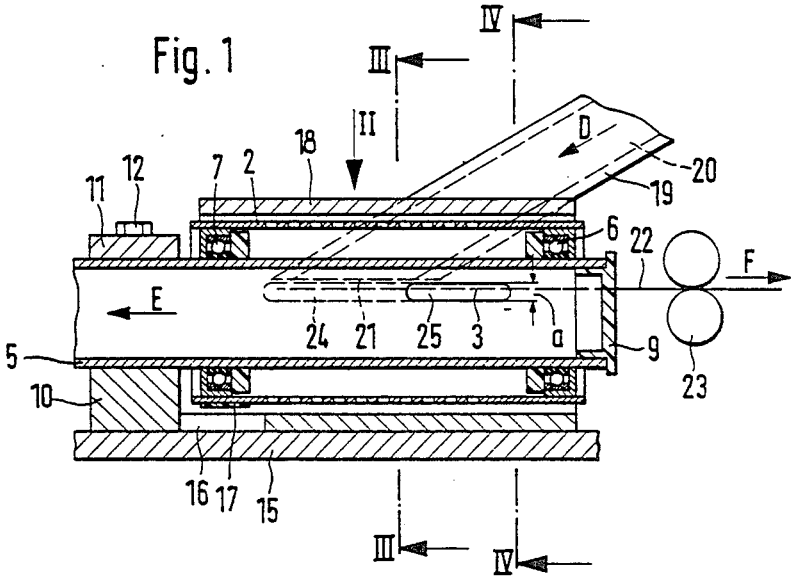
FIG. 1 is a partial schematic longitudinal sectional view taken through an apparatus constructed in accordance with a preferred embodiment of the invention.

The apparatus or device for open-end friction spinning described in the drawings includes two parallel closely adjacent friction rollers 1 and 2 which together form a yarn forming wedge-shaped gap 3. Each roller 1 and 2 includes a suction pipe 4 and 5 respectively in their interior, wherein the shells of rollers 1 and 2 are directly borne upon respective roller bearings 6 and 7. The suction pipes 4 and 5 are closed at their face ends with plugs 8 and 9, respectively. The other end of the suction pipes 4 and 5 is guided out of the rollers 1 and 2 and fixedly held in a roller housing 10 by means of a clamping element 11. The clamping element 11 is fastened by means of screws 12 and 13 at the roller housing 10. The roller housing 10 adjacent the area of the clamping element 11 exhibits a U-shaped profile such that the element surrounds rollers 1 and 2 in the area of their shells. The open side of the U-shaped roller housing 10 is covered by a cover element 18 extending at least partially over the axial length of rollers 1 and 2 such that rollers 1 and 2 are encased over their entire axial length. The roller housing 10 includes a flange at its side opposite the cover 18, which is screwed with screws 14 at a carrier frame 15 of a machine.

Figure 3:
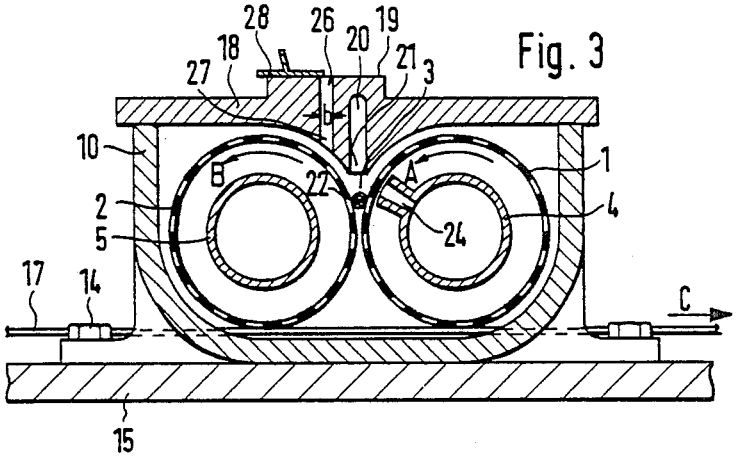
FIG. 3 is a schematic sectional view taken along line III—III of FIG. 1.
Figure 4:
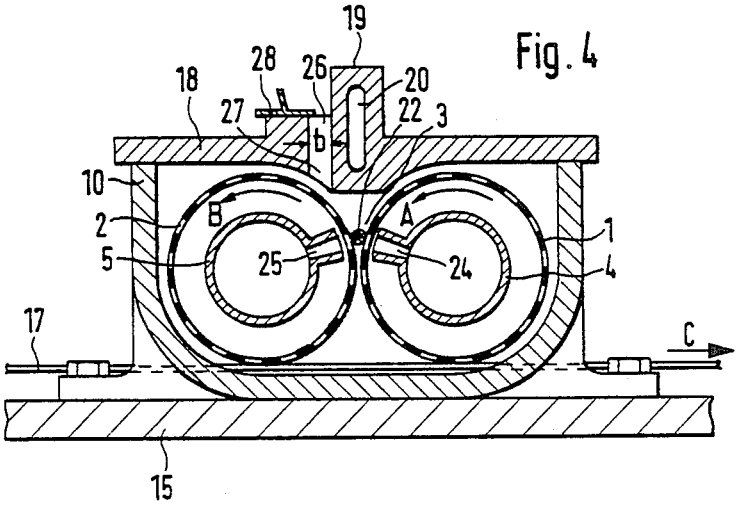
FIG. 4 is a schematic sectional view taken along line IV—IV of FIG. 1.

In the area of the roller bearing 7 located adjacent the clamping element 11, the roller housing 10 is provided with a recess 16 through which is guided a tangential belt 17 contacting directly against the shell surfaces of rollers 1 and 2 and driving them in the same rotational direction. An open-end friction spinning machine includes a plurality of spinning units of that type illustrated in the drawing which are arranged side by side in a row. The tangential belt 17 runs through the machine in arrow direction C and drives the rollers 1 and 2 of all spinning units at least on one side of the machine. As can be seen in FIGS. 3 and 4, the tangential belt 17 drives rollers 1 and 2 in the same rotational direction as designated by arrows A and B such that roller 1 rotates inwardly toward the wedge-shaped gap 3, while roller 2 rotates outwardly of the same.

A fiber feed channel 20 is guided through the cover element 18 which is either fitted into the cover element 18 or is designed as a separately manufactured component part. The fiber feed channel 20 includes a slot-like opening 21 extending in the longitudinal direction of the wedge-shaped gap 3 and is situated at a very small distance opposite the gap 3. The fiber feed channel 20 connects a fiber feed and opening device (not illustrated) through which a fiber sliver is drawn into and is opened, in a known manner, into single fibers supplied to rollers 1 and 2 in arrow direction D through the fiber feed channel 20 to the wedge-shaped gap 3.

Figure 2:
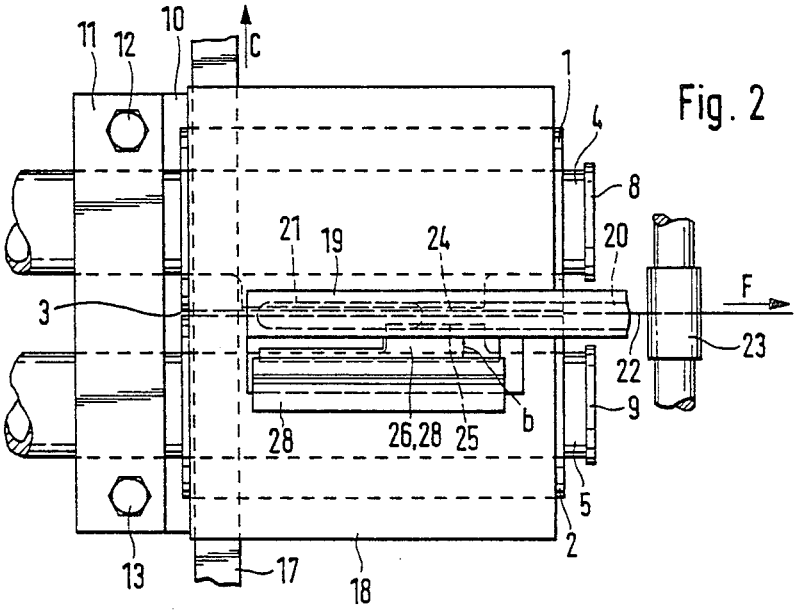
FIG. 2 is a top schematic view of the apparatus or device according to FIG. 1 taken in the arrow direction II of FIG. 1.

The mouth or opening 21 of the fiber feed channel 20 forms the so-called dispersion zone in which single fibers are fed to form a yarn 22 which is then drawn off by a withdrawal device comprising a pair of withdrawal rollers 23 in arrow direction F. As can be seen especially from FIGS. 1 and 2, the rollers 1 and 2 extend beyond the area of the opening 21 of the fiber feed channel and continue to form a wedge-shaped gap 3 over which the producing yarn 22 is drawn off. This area is the so-called treatment zone.

The two suction pipes 4 and 5 are connected (in a not further described manner) to an underpressure or vacuum source. They are provided with suction slots 24 and 25, which are directed toward the area of the wedge-shaped gap. The two suction slots 24 and 25 are surrounded by means of ridges or inserts or the like such that they start out adjacent the inner side of the shells of rollers 1 and 2. The shells of rollers 1 and 2 are perforated in the area of the dispersion zone and the treatment zone. Air streams are thereby taken in through the perforated shells of rollers 1 and 2 which flow off in the direction of arrow E to the subpressure or vacuum source that is not shown here. As can be seen from FIGS. 1 and 2, the suction slot 24 of roller 1 rotating into the wedge-shaped gap 3 extends not only beyond the area of the dispersion zone (opening 21 of the fiber feed channel 20), but also beyond the area of the adjacent treatment zone. The suction slot 25 of roller 2 rotating out of the wedge-shaped gap 3 extends, on the other hand, only beyond the area of the treatment zone, therefore it starts out approximately at the end of the mouth 21 facing the pair of yarn-withdrawal rollers 23.

The air streams sucked in via the suction slots 24 and 25 flow through the fiber feed channel 20 and an air inlet opening 26. The air inlet opening 26 starts out in the area of the dispersion zone adjacent the mouth or opening 21 of the fiber feed channel 20 and extends into the area of the end of the treatment zone. As can be seen from FIGS. 3 and 4, the air inlet opening 26 varies in size or is varying in size along the longitudinal direction of the wedge-shaped gap 3 with its width b being different at different longitudinal positions of the gap. The air inlet opening 26 thereby exhibits a clearly smaller width b in the area of the dispersion zone, as compared to in the area of the following treatment zone. In order to additionally control the amount of air admitted by the air inlet opening 26, a slider 28 is provided for adjusting the in-flow cross-section of the air inlet opening 26.

In the shown embodiment, it is provided that the air inlet opening 26 is directed toward roller 2 rotating out of the wedge-shaped gap 3. It is contemplated with other embodiments to position one or several air inlet openings in a different manner. For example, one of the embodiments contemplated provides that the air inlet opening 26 only extends beyond the area of the treatment zone and is then arranged in an extension of the opening 21 of the fiber feed channel 20. It is also contemplated to form the air inlet opening 26 with a section of several elements which are staggered with respect to each other according to certain embodiments. The section is in the area of the dispersion zone and extends parallel to the opening 21 of the fiber feed channel 20 and which is subsequently directed as an extension of opening 21 cf the fiber feed channel 20 in the treatment zone. Furthermore, with other embodiments it is also contemplated to adjust the air inlet opening 26 toward roller 1 rotating into the wedge-shaped gap 3.

In the shown embodiment, it is provided that the suction slots 24 and 25 are of the same width a, but have different lengths in longitudinal direction of the wedge-shaped gap 3 in order to proportion or regulate the suction effect in the longitudinal direction of the gap 3. Such proportioning or regulating effect is also contemplated in connection with other measures and especially other types of suction slots according to certain preferred embodiments. Furthermore, it is also contemplated to arrange the suction slots different distances from the wedge-shaped gap 3 in order to obtain different suction effects and thereby different friction effects. Thereby, certainly other provisions can be made in exchange for the progressive changes in the total cross-section of the suction slots 24 and 25 according to certain contemplated embodiments of the invention. Other changes are provided, especially a continuing adjustment in other preferred contemplated embodiments. In practice, it is thereby commonly provided to increase the suction effects in the direction of the yarn withdrawal (arrow F) such that the suction effect is less in the area of the producing yarn tip than in the treatment zone. The air inlet opening 26 is dimensioned accordingly, therefore the possible air streams in yarn withdrawal direction are larger.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An arrangement for open-end friction spinning of yarn comprising:

two friction rollers rotatably drivable in the same direction and disposed adjacent one another to form a yarn forming wedge-shaped gap therebetween;

fiber supplying means for supplying individual fibers in a dispersion zone to the wedge-shaped gap;

housing means at least partially enclosing a space accommodating the friction rollers;

yarn withdrawal means for withdrawing yarn from the wedge-shaped gap in the longitudinal direction of said wedge-shaped gap out of the dispersion zone and subsequently through a treatment zone of the wedge-shaped gap; and suction means for generating an air current directed into a wedge-shaped gap, the suction means including means for creating differential suction forces at different axial zones of the wedge-shaped gap, wherein the suction means includes suction slot means inside at least one of the rollers facing in the direction of the wedge-shaped gap and extending essentially in longitudinal direction to the gap, said suction slot means having a cross section which varies in the longitudinal direction of said wedge-shaped gap, and an air inlet in said housing means extending essentially in longitudinal direction of the wedge-shaped gap and having an air inlet opening which is adjustable as a function of the cross section of the suction slot means.

2. An arrangement for open-friction spinning yarn comprising:

two friction rollers rotatably drivable in the same direction and disposed adjacent one another to form a yarn forming wedge-shaped gap therebetween;

fiber supplying means for supplying individual fibers in a dispersion zone to the wedge-shaped gap;

housing means at least partially enclosing a space accommodating the friction rollers;

yarn withdrawal means for withdrawing yarn from the wedge-shaped gap in the longitudinal direction of said wedge-shaped gap out of the dispersion zone and subsequently through a treatment zone of the wedge-shaped gap; and suction means for generating an air current directed into a wedge-shaped gap, the suction means including means for creating differential suction forces at different axial zones of the wedge-shaped gap, wherein the suction means includes suction slot means inside at least one of the rollers facing in the direction of the wedge-shaped gap and extending essentially in longitudinal direction to the gap, said suction slot means having a cross section which varies in the longitudinal direction of said wedge-shaped gap, and an air inlet in said housing means extending essentially in longitudinal direction of the wedge-shaped gap and having an air inlet opening which has a cross section of such a dimension that the dimensional relation between the cross section of said air inlet opening and the cross section of said suction slot means is essentially constant in the longitudinal direction of said wedge-shaped gap.

3. An arrangement for open-end friction spinning yarn comprising:

two friction rollers rotatably drivable in the same direction and disposed adjacent one another to form a yarn forming wedge-shaped gap therebetween;

fiber supplying means for supplying individual fibers in a dispersion zone to the wedge-shaped gap;

housing means at least partially enclosing a space accommodating the friction rollers;

yarn withdrawal means for withdrawing yarn from the wedge-shaped gap in the longitudinal direction of said wedge-shaped gap out of the dispersion zone and subsequently through a treatment zone of the wedge-shaped gap; and suction means for generating an air current directed into the wedge-shaped gap, the suction means including means for cresting differential suction forces at different axial zones of the wedge-shaped gap, wherein the suction means includes suction slot means inside at least one of the rollers facing in the direction of the wedge-shaped gap and extending essentially in longitudinal direction to the gap, and an air inlet in said housing means extending essentially in longitudinal direction of the wedge-shaped gap and having an air inlet opening, said suction slot means having a cross-sectional dimension which varies in the longitudinal direction of said wedge-shaped gap and said air inlet opening having a cross-sectional dimension, the ratio of said suction slot means cross-sectional dimension and said inlet opening cross-sectional dimension being essentially constant in the longitudinal direction of said wedge-shaped gap.

4. An arrangement according to claim 3, wherein the suction slot means includes suction slot means in both of the rollers, and wherein the suction slot means have a total cross-section which varies in longitudinal direction of the wedge-shaped gap.

5. An arrangement according to claim 4, wherein the air inlet varies in size along the length of the wedge-shaped gap as a function of the total cross-section of the suction slot means in longitudinal direction of the wedge-shaped gap.

6. An arrangement according to claim 4, wherein the suction slot means of the respective rollers each have different lengths in longitudinal direction of the wedge-shaped gap.

7. An arrangement according to claim 6, wherein the suction slot means inside the roller rotating out of the wedge-shaped gap extends only from within the dispersion zone into the treatment zone.

8. An arrangement according to claim 7, wherein the suction slot means inside the roller rotating into the wedge-shaped gap extends in longitudinal direction from outside the dispersion zone on one end of the wedge-shaped gap dispersion zone through the dispersion zone and into the treatment zone on a second end of the wedge-shaped gap.

9. An arrangement according to claim 8, wherein the air inlet extends beyond the dispersion zone on one side of the wedge-shaped gap and beyond the treatment zone on the other side of the wedge-shaped gap.

10. An arrangement according to claim 8, wherein the air inlet extends essentially over the area of the treatment zone.

11. An arrangement according to claim 8, wherein the size of the air inlet decreases from the dispersion zone toward the treatment zone.

12. An arrangement according to claim 6, wherein the suction slot means inside the roller rotating into the wedge-shaped gap extends in longitudinal direction from outside the dispersion zone on one end of the wedge-shaped gap dispersion zone through the dispersion zone and into the treatment zone on a second end of the wedge-shaped gap.

13. An arrangement according to claim 3, wherein adjusting means are provided for selectively adjusting the size of the air inlet opening.

14. An arrangement according to claim 3, wherein said housing means includes an integral housing cover and a housing element surrounding both rollers in the area of the dispersion and treatment zones.

15. An arrangement according to claim 14, wherein said air inlet and said fiber feed channel extend through said housing cover.

16. An arrangement according to claim 15, wherein adjusting means are provided for selectively adjusting the size of the air inlet opening.

* * * * *